US005639318A

United States Patent [19]

Edelstein et al.

[11] Patent Number: 5,639,318

[45] Date of Patent: Jun. 17, 1997

[54] OXIDATION RESISTANT COPPER

[75] Inventors: Alan S. Edelstein, Alexandria, Va.; Forrest H. Kaatz, Appleton, Wis.; Vincent G. Harris, Beltsville, Md.

[73] Assignee: The United States of America as represented by the Secretary of the Navy, Washington, D.C.

[21] Appl. No.: 519,007

[22] Filed: Aug. 24, 1995

Related U.S. Application Data

[62] Division of Ser. No. 151,693, Nov. 15, 1993, Pat. No. 5,470,373.

[51] Int. Cl.[6] ..... B22F 9/24

[52] U.S. Cl. ..... 148/513; 75/351; 75/365; 75/373

[58] Field of Search ..... 75/351, 365, 369, 75/373; 148/513

[56] References Cited

U.S. PATENT DOCUMENTS

| | | | |
|---|---|---|---|
| 2,754,193 | 7/1956 | Graham et al. | 75/351 |
| 3,583,864 | 6/1971 | Adler | 75/351 |
| 4,778,517 | 10/1988 | Kopatz et al. | 75/351 |
| 5,486,225 | 1/1996 | Dye et al. | 75/351 |

*Primary Examiner*—George Wyszomierski
*Attorney, Agent, or Firm*—Thomas E. McDonnell; George E. Kap

[57] ABSTRACT

Oxidation resistant particles composed of copper and at least one metal having a valence of +2 or +3 and having an intermediate lattice energy for the metal in its hydroxide form. The metal is selected from nickel, cobalt, iron, manganese, cadmium, zinc, tin, magnesium, calcium and chromium. In one embodiment, the phases of copper and at least one metal in the particles are separate and the concentration of the metal is greater near the surface of the particles than inwardly thereof. Process for making the oxidation resistant copper particles includes the steps of dissolving a copper salt and a salt of at least one of the metals in a suitable solvent or diluent; forming primary particles of copper and at least one metal in basic form by mixing a base and the salt solution; separating, washing and drying the primary particles; reducing the primary particles to metallic form; and heat treating the particles in metallic form at an elevated temperature.

9 Claims, 3 Drawing Sheets

OXIDATION RESISTANT COPPER

This application is a division of application Ser. No. 08/151,693, filed Nov. 15, 1993, now U.S. Pat. No. 5,470, 373.

FIELD OF INVENTION

This invention relates to the field of electrical conductors, and more particularly to oxidation resistant modified copper and processes for making the same.

BACKGROUND OF INVENTION

It is desirable to manufacture electrical interconnection systems from copper or a copper alloy due to the high electrical conductivity of copper and copper alloys. However, copper readily oxidizes to form compounds that are poor conductors, thus reducing its overall electrical conductivity. To prevent a gradual increase in its resistivity due to oxidation, a protective coating has been applied in the past, selected particularly from gels or metals such as gold and tin.

Copper is currently being considered as a potential metallization material for ultra-large scale integration applications because of its low electrical resistivity and good resistance to electromigration relative to the material currently used, i.e., aluminum or aluminum alloys. Unfortunately, as is well known, copper oxidizes rapidly to form an oxide which is neither a protective oxide nor is electrically conducting. In fact, the high reactivity of copper with its environment is one of the factors that limits the applicability of copper as an interconnect metal.

The problem of oxidation is especially severe in small copper or copper-containing particles, such as on the scale of nanoparticles, because the small particles have a large fraction of their atoms at or near the surface. Thus, the small particles are generally very sensitive to surface oxidation and contamination.

OBJECTS OF INVENTION

An object of this invention is to produce copper powder particles that are oxidation resistant, highly electrically conductive and which have low electromigration;

Another object of this invention is to produce copper-metal oxidation resistant nanoparticles wherein the metal can be in a separate phase from copper and is in a greater concentration at the surface of the particles than at the core thereof;

Another object of this invention is a process for making the oxidation resistant copper-metal particles by reacting a copper salt with a metal salt or a mixture of metal salts, precipitating and reducing primary particles to form the product particles which are oxidation resistant.

SUMMARY OF INVENTION

The particulate modified copper material of this invention is oxidation resistant compared to unoxidized copper and is resistant to electromigration. The material is in the form of nanoparticles of copper and at least one metal other than copper. The metal can be in a separate phase and is associated with copper whereby the concentration of the metal increases from the core outwardly to the surface of the particles. The process for making the modified copper particles includes the steps of reacting copper ionic species with at least one metal ion, forming primary particles of copper and at least one of the metals by the use of a base, reducing the primary particles at an elevated temperature to form the copper-metal particles with copper being in its own phase apart from the metal.

DETAILED DESCRIPTION OF INVENTION

Figure 1:
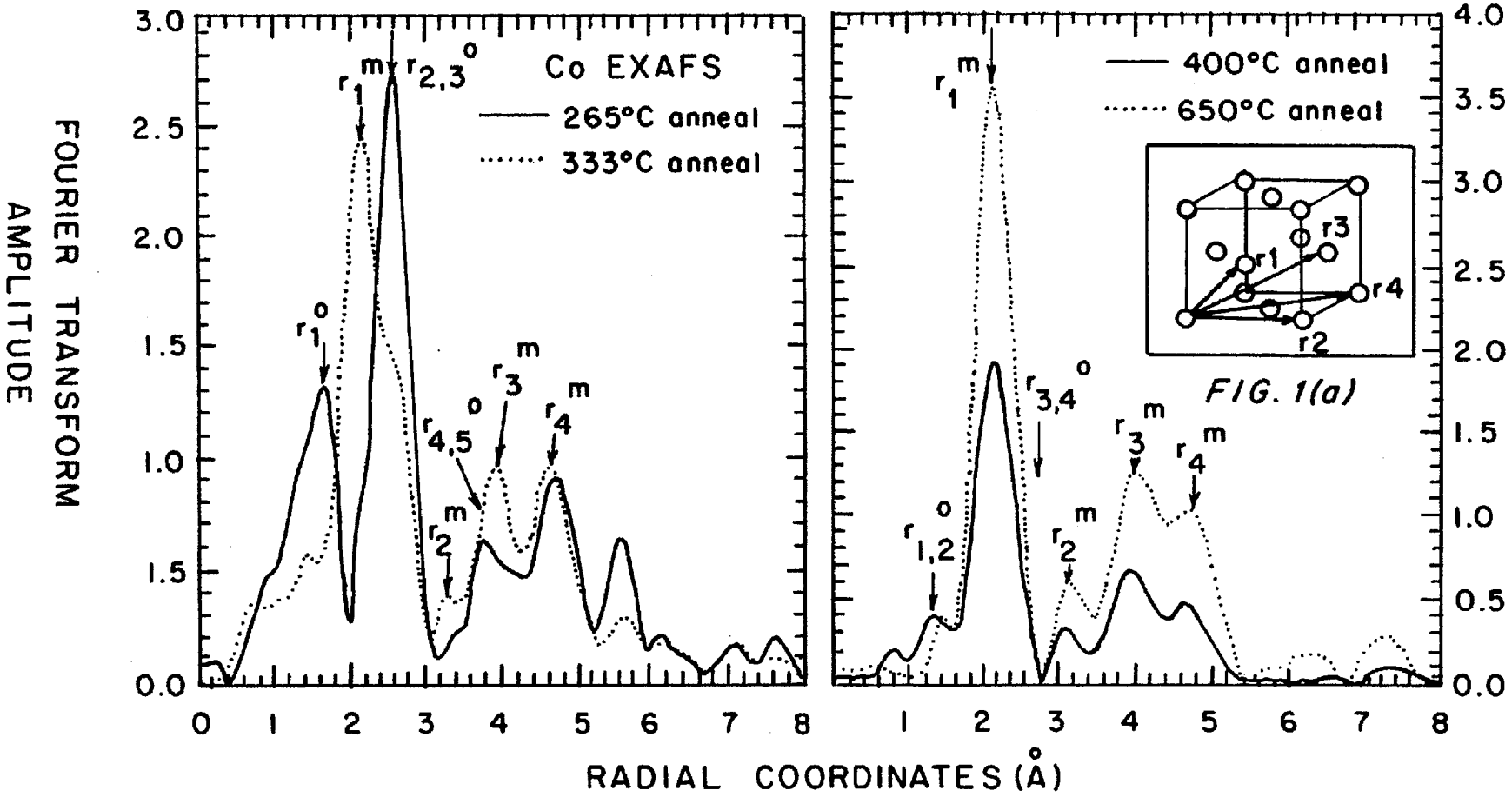
FIGS. 1 shows plots of the fourier transform extended x-ray absorption fine structure (EXAFS) data variation with radial coordinates and show the location of oxygen and metal sites relative to the absorbing atom.

The oxidation resistant particulate product of this invention consists of copper and at least one modifying metal selected from nickel, cobalt, iron, manganese, cadmium, tin, zinc, magnesium, calcium and chromium. The average diameter of most of the product particles is in the nanometer range and in a preferred embodiment, at least 90% of the product particles is in the nanometer range. The products of this invention include the following:

1. phase separated particulate products (a) mixtures of copper particles and metal particles wherein the copper particles comprise copper and at least one modifying metal particle in separate phases. The modifying metal particles are separated from the copper particles by less than 100 nm. Typically, the metal particles touch the copper particles creating a limited interface between the copper and the metal particles; and (b) a single particle product where the metal portion is touching the copper portion through an extended interface.

2. particulate alloy or metastable alloy product having at least one of the metals randomly distrubuted throughout the product particle.

For the purpose of this invention, we define a limited interface as one covering less than one-half the particle surface whereas an extended interface covers more than one-half the particle surface. In product 1(*a*), above, the metal is selected from cobalt, iron, chromium, calcium and mixtures thereof. In product 1(*b*), above, the metal is selected from cobalt, iron and mixtures thereof with or without copper. In product 2, above, the metal is selected from nickel, cobalt, iron, manganese, magnesium, tin, cadmium, zinc and mixtures thereof. Typically, the particles are materials in which the grain size is less than about 100 nm. In one embodiment, the product particles have copper in a separate phase from the metal and concentration of the metal in the product particles is greater near the surface than the center thereof. Atomic ratio of copper to metal in the particulate product is in the range of about 0.1–10, preferably 1–5. In a preferred embodiment, the particulate product of this invention consists of copper and one metal selected from cobalt, iron, manganese, cadmium, chromium and mixtures thereof.

The process for making the product does not significantly reduce the electrical conductivity nor processability. The process includes the steps of reacting copper ions with at least one metal ion, precipitating out primary particles and subjecting them to an elevated temperature to form copper-metal particles wherein the metal is in a separate phase from copper. The reaction steps for a 50-50 mixture of copper (Cu) and metal (M) in an aqueous solution can be depicted as follows:

$$Z^{2+}_{(aq)}+2OH^{-}_{(aq)}\rightarrow Z(OH)_2$$

where Z is copper (Cu) or metal (M) or a copper metal mixture (alloy) and metal (M) is a metal other than copper and is defined herein.

The initial reaction of a copper salt and at least one metal salt can take place at room temperature up to about 100° C. with the salts disposed in a suitable liquid medium which can be a solvent or a diluent for the salt. Examples of suitable liquid media include water, alcohols and mixtures of water and alcohols. The copper salt in a liquid medium is mixed with at least one metal salt which can also be in a liquid medium. The total concentration of salt in the liquid medium can be from about 0.2 to about 7 molar, preferably 1 to 5 molar. Amount of copper to the metal or a mixture thereof can be varied to the desired level, however, typically, the relative atomic ratio of copper to the metal or a mixture thereof for purposes herein is in the range of 0.1–10, preferably 1–5.

Various salts of copper and metals can be used in the reaction to form hydroxide particles containing copper and at least one metal upon further reaction with a base. Salts which can be used include halides, nitrates, acetates, perchlorates, sulfates and other soluble salts. Preferred salts are the commercially available chlorides which are moderately priced.

By adding a base to the solution or dispersion, primary particles are precipitated which contain copper, and/or at least one of the metals, and a basic moiety. Alternatively, one could add the metal salt solution to the base. The primary particles in the above equations are denoted as $Z(OH)_2$.

The metal that can be combined with copper in the manner described herein is selected so that the final product has oxidation resistance and electromigration resistance. It appears that a suitable metal has a valence of +2 and has an intermediate lattice energy in its hydroxide form. If the lattice energy of the metal hydroxides is too low, precipitation or formation of the primary particles will not take place, and if the hydroxide lattice energy is too high, then oxides will form in place of the primary particles and the oxides would be too stable to be reduced to the final metallic particulate product. It is estimated that the intermediate lattice energy of the suitable metal hydroxides is in the approximate range of about 2000–3200 kJ/mole, preferably about 2500–3000 kJ/mole. A representative sample of suitable metals in hydroxide form and their lattice energies is given below:

| Material | Crystal Lattice Energy (kJ/mole) |
|---|---|
| $Co(OH)_2$ | 2786 |
| $Fe(OH)_2$ | 2653 |
| $Mn(OH)_2$ | 2909 |
| $Ca(OH)_2$ | 2506 |
| $Cd(OH)_2$ | 2607 |
| $Sn(OH)_2$ | 2489 |
| $Mg(OH)_2$ | 2870 |

Copper hydroxide or $Cu(OH)_2$ has lattice energy of 2870 kJ/mole.

The primary particles are formed or precipitated from the solution or dispersion by adding a base thereto. A base is a metallic hydroxide which furnishes OH— ions in solution. Although a strong base, such as sodium hydroxide (NaOH), is preferred, suitable bases herein include potassium hydroxide, barium hydroxide, and ammonium hydroxide. Most metallic hydroxides are insoluble in water. Of the common ones, only sodium hydroxide, potassium hydroxide, and barium hydroxide are soluble in water. When the bases are dissolved in water, the ions are dispersed in the solution.

The amount of the base that is added to the solution or dispersion should be an effective amount to form solid, primary particles. The base is preferably added incrementally, as dropwise or as an aerosol, to precipitate the primary particles.

The primary particles are formed as a result of a conventional reaction of a metal ion and an hydroxide ion, as discussed earlier.

Following precipitation, the primary particles ($ZOH_2$) in solid form are separated from the liquid phase and then washed and dried. Separation of the primary particles should be accomplished in a way to preserve the particulate nature of the primary particles. Washing of the basic particles can be done with water or another liquid to remove impurities therefrom and drying can be done in a furnace at a low temperature and at a reduced pressure or humidity.

The primary particles, which are hydroxides, are then reduced to form the final particulate product which is in metallic form, i.e., copper-metal or Cu—M particles. The primary particles may go through an intermediate oxide phase. Reduction can be accomplished by contacting a reducing gas with the dry primary particles until the primary particles are converted to the metallic form. Reduction of the primary particles can also be done by contacting the primary particles with a reducing solution or dispersion until the basic particles are converted to the metallic form. If a reducing gas is used in the reduction step, it is preferred to flow the gas through the basic particles until the desired transformation takes place. Suitable reducing gases include hydrogen and carbon monoxide. Typically, hydrogen gas is used as the reducing gas. The duration of flowing a reducing gas through the primary particles will, of course, depend on factors such as the specific reducing gas used, its concentration in the flowing medium, its flow rate, its temperature, etc., however, typically, this duration period should not be longer than several hours, preferably 1 minute to 10 hours, and more preferably 10 minutes to 2 hours.

At this point, the particulate product is in a metallic form (Cu—M). One or more types of metal atoms may be randomly distributed along with the copper atoms throughout the particle. In this case, since the metal is randomly distributed throughout the copper particle, the resistivity of primary particles is relatively high due to the nature of the distribution.

In order to decrease electrical resistivity of the particulate product, the reducing temperature must be high enough that phase separation occurs within the allocated time. Reducing the hydroxide at these higher temperatures causes the metal atoms to separate from the copper phase and it is believed that in some cases the metal atoms have a gradient concentration whereby concentration of the metal is greater at the surface of the particle than at its core. Reducing temperature is typically in the range of about 100° to 900° C.

Heat treatment of the metallic particles can be carried out by placing the metallic particles in a furnace and subjecting them to an elevated temperature until phase separation takes place between copper and the metal or until a solid solution is formed whereby at least one of the modifying metals is randomly distributed in the particle. Phase separation is a kinetic process which takes place in a range of temperatures which depends on the constituents. It is, however, expected that the heat treatment temperature of the metallic particles will be in the approximate range of 100°–900° C., preferably 400°–700° C. Duration of the heat treatment should be as long as it takes to achieve phase separation, however, this period should be in the approximate range of 1 minute to 10 hours, preferably 10 minutes to 2 hours.

Before phase separation occurs, the particulate alloy particles of copper and at least one of the metals may form. In such an alloy product, the metal atoms are randomly distributed throughout the particles and as a result, such an alloy product does not possess an electrical conductivity comparable to copper. The metastable alloy or a product which is heat treated to be partially phase-separated may be useful for giant magnetoresistance applications.

Typically, the reduced metallic particles that contain copper are face centered cubic (fcc) phases. These phases include the metastable alloy phase and the phase-separated phases. After phase separation occurs, the phase that does not contain copper can have a different crystal structure.

The transformed extended x-ray absorption fine structure (EXAFS) data provides information about the number and type of atoms which are neighbors of the metal atoms as a function of the distance away from the metal atoms. After reduction to the metallic form, but before phase separation occurs, all neighbors of metal atoms are either copper atoms or other metal atoms and the structure is that of an fcc metal. Since the EXAFS and x-ray diffraction data unambiquously shows that the metal atom is in the fcc lattice but with a lattice constant close to that of copper from XRD, it is reasonable to infer from this that the copper and the metal atoms are in a solid solution after heat treatment before phase separation occurs.

A long enough heat treatment at a sufficiently high temperature will cause the alloy to phase separate or to form a solid solution. Evidence for this resides in the x-ray diffraction of the final particulate product which shows that copper and the metal are clearly separate. Magnetization data taken as a function of the heat treating temperature is consistent with this evidence.

The final product is particulate with a majority of the particles having average diameter in the nanometer range. Although some particles may be outside of the nanometer range, a large majority of the particles are in the nanometer range. In a preferred embodiment, at least 90% of the particles have average diameters in the approximate range of 1–100 nm.

It may be possible to combine the reducing and heat treating steps. This can be done by reducing the basic particles at or above the phase separation temperature. If a reducing gas is used, the temperature thereof may be high enough to cause phase separation of copper and at least one of the metals.

As earlier stated, the metallic particulate product of this invention comprises copper and at least one metal in association therewith wherein at least one of the metals has concentration which is greater at about the surface of the particles than it is at the core or center thereof. Evidence of this phenomenon is provided by x-ray photoemission spectroscopy (XPS), which is sensitive to the first few layers of atoms. The XPS measurements indicate a higher ratio of metal to copper at the surfaces than in the bulk of the particles.

Based on the observed oxidation of the particulate product, it is hypothesized that when phase separation occurs, the metal atoms migrate to the surface and provide a physical barrier which inhibits oxidation.

After consolidating the particulate product at room temperature, the resistivity of the compacted particulate product can be decreased by nearly a factor of 2 on cooling to 5K. Room temperature resistivity was about 4.5 μΩcm in one sample. The density of the compact can be about 95% of the bulk value.

The oxidation resistance of the product copper-metal particles was investigated by comparing them with copper particles prepared in the same, identical manner as the product, preparation of which is described above. Both the product and the copper particles were exposed to air and repeated x-ray scans were made to determine the fraction of coppper that was metallic and the fraction that was copper oxide ($Cu_2O$), i.e., the most common oxidation product. The data obtained showed that the copper-metal particulate product is much more oxidation resistant than the particulate copper.

Oxidation resistance of the herein-disclosed particulate product is effective for a period of about ten days when exposed to room environment at room temperature. This oxidation resistance can be extended in known ways, including storing the product in an inert atmosphere, storing the product at a reduced temperature, or both. When stored in liquid nitrogen, the product disclosed herein can retain oxidation resistance indefinitely.

In some embodiments of this invention, phase separation occurs without going through the formation of an intermediate alloy or a metastable alloy. In some embodiments, no phase separation takes place and the particles are alloys.

In some applications, such as electronics, materials must withstand processing at elevated temperatures. After exposing the novel particulate product disclosed herein to elevated temperatures and noting the progressive oxidation thereof at the elevated temperatures, it can be concluded that nearly all of the novel products can withstand processing temperatures of at least 250° C.

The invention having been generally described, the following examples are given as particular embodiments of the invention to demonstrate the practice and advantages thereof. It is understood that the examples are given by way of illustration and are not intended to limit in any manner the specification or the claims that follow.

EXAMPLE 1

This example demonstates preparation of about $Cu_{0.80}Co_{0.20}$ particulate product composition.

Copper chloride dihydrate and cobalt chloride hexahydrate were dissolved at room temperature in distilled and deonized water (DDW) to yield a metal ion molarity of 0.5. Primary particles were precipitated from the solution by adding 5M NaOH to the solution dropwise. The primary particles were hydroxides of copper (Cu) and cobalt (Co) which are believed to be a mixture of $Cu(OH)_2$, $Co(OH)_2$ and possibly a mixed hydroxide containing both copper and cobalt. The basic particles were filtered from the solution and then were washed with DDW and dried in air overnight. To obtain free-flowing, dry primary particles, the agglomerated portions were broken up.

The primary particles in free-flowing form were placed in a ceramic boat, the boat with the particles was placed in a quartz tube and the tube was then placed in a furnace initially at room temperature. A flow of hydrogen gas at 25 ml/min was maintained for one half hour through the tube before the temperature in the furnace was ramped from room temperature to 650° C. over a period of three hours. The flow rate of hydrogen gas was maintained throughout the heating cycle. The furnace with the particulate product in it was maintained for one hour at 650° C. and then was cooled to room temperature overnight.

The particulate product had average diameter of 10–30 nanometers (nm), was about $Cu_{0.80}$ $Co_{0.20}$, had separate copper and cobalt phases, was oxidation resistant, and appeared to have greater concentration of cobalt near the surface of the particles than at the core.

EXAMPLE 2

This example demonstrates phase separation and oxidation resistance of the reduced basic particles prepared as in Example 1.

During the reduction process, the particles go through a number of stages, depending on the heat treating temperature. Particles of Cu—Co alloy appear to form at heat treating temperatures of 330° C. and 400° C. The alloy is a solid solution wherein copper and cobalt are generally randomly distributed and has poor electrical conductivity compared to copper. The cobalt atoms are in a fcc Cu—Co alloy, as evidenced by the combined use of absorption fine structure and x-ray diffraction data. The EXAFS data, presented in FIG. 1, shows that the cobalt atoms are in the fcc crystal structure after the particles of Example 1 are heat treated at 330° and 400° C. FIG. 1 shows the Fourier transform of the EXAFS data for the reduced primary particles.

Figure 2:
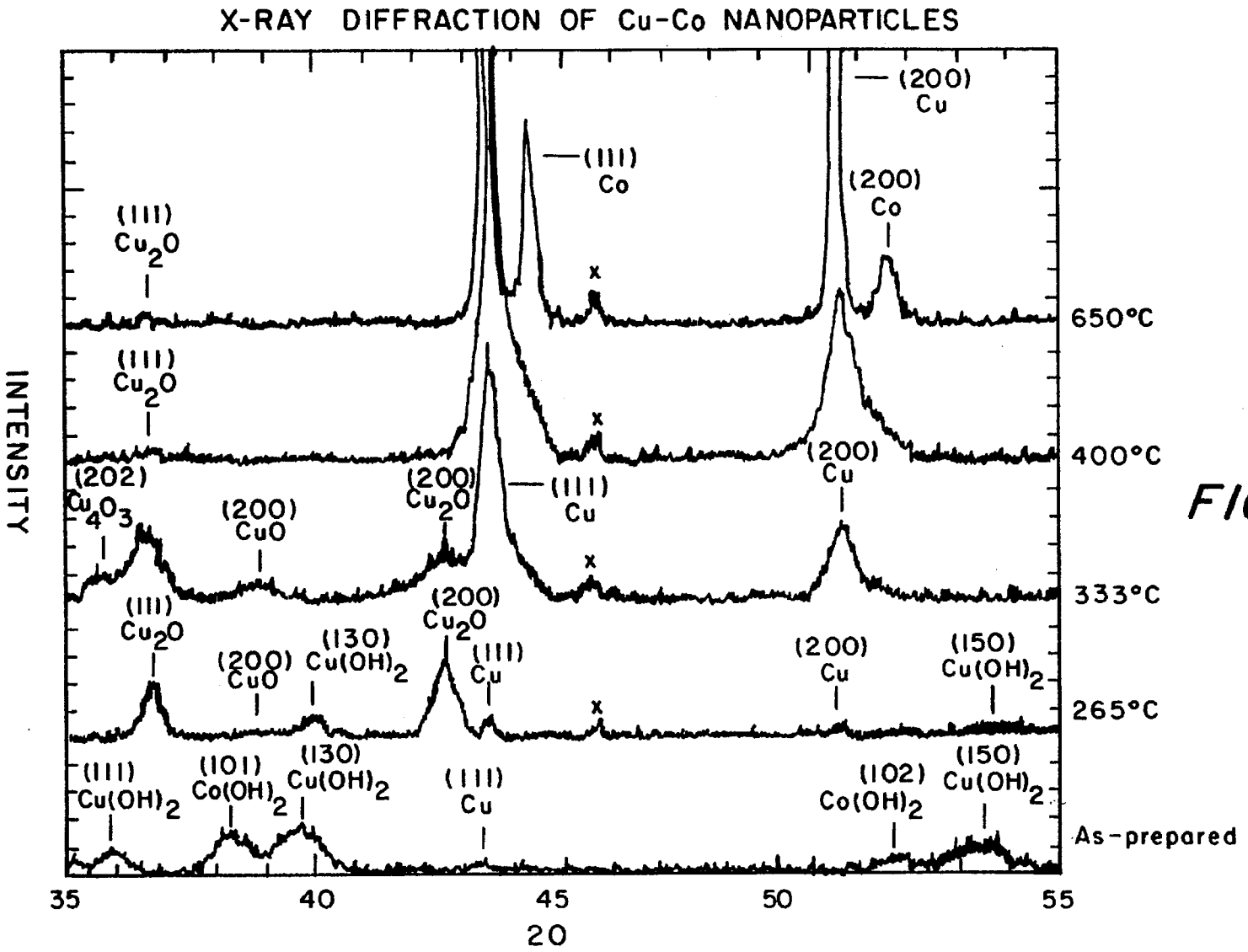
FIG. 2 is a plot of X-ray Intensity variation with 2Θ and shows the phases present in the as-prepared and heat treated material.

The Fourier transformed EXAFS data provides information about the number and type of atoms which are neighbors of the cobalt atoms as a function of distance away from the cobalt atoms. The "o" and "m" superscripts in FIG. 1 indicate oxygen atom positions and the fcc metal atom positions, respectively. At 265° C., the cobalt atoms are surrounded by oxygen nearest neighbors. At 330° C., 400° C., and 650° C., nearly all the neighbors of cobalt atoms are either copper atoms or other cobalt atoms and the structure is that of an fcc metal. The only metallic diffraction peaks seen in the x-ray in FIG. 2 are those of fcc peaks of copper at 330° C. and 400° C. Since the EXAFS data shows that the cobalt is in a fcc lattice, it is inferred that the cobalt and copper are in a solid solution after being annealed at 330° C. and 400° C.

Annealing at 650° C. for one hour causes the alloy to phase separate, see FIG. 2, apparently reflecting that copper has separated from cobalt at that point. Evidence for this is the cobalt x-ray diffraction peak which is clearly separated after the 650° C. heat treatement. Magnetization data taken, as a function of the heat treating or annealing temperature, is also consistent with this interpretation.

Figure 3:
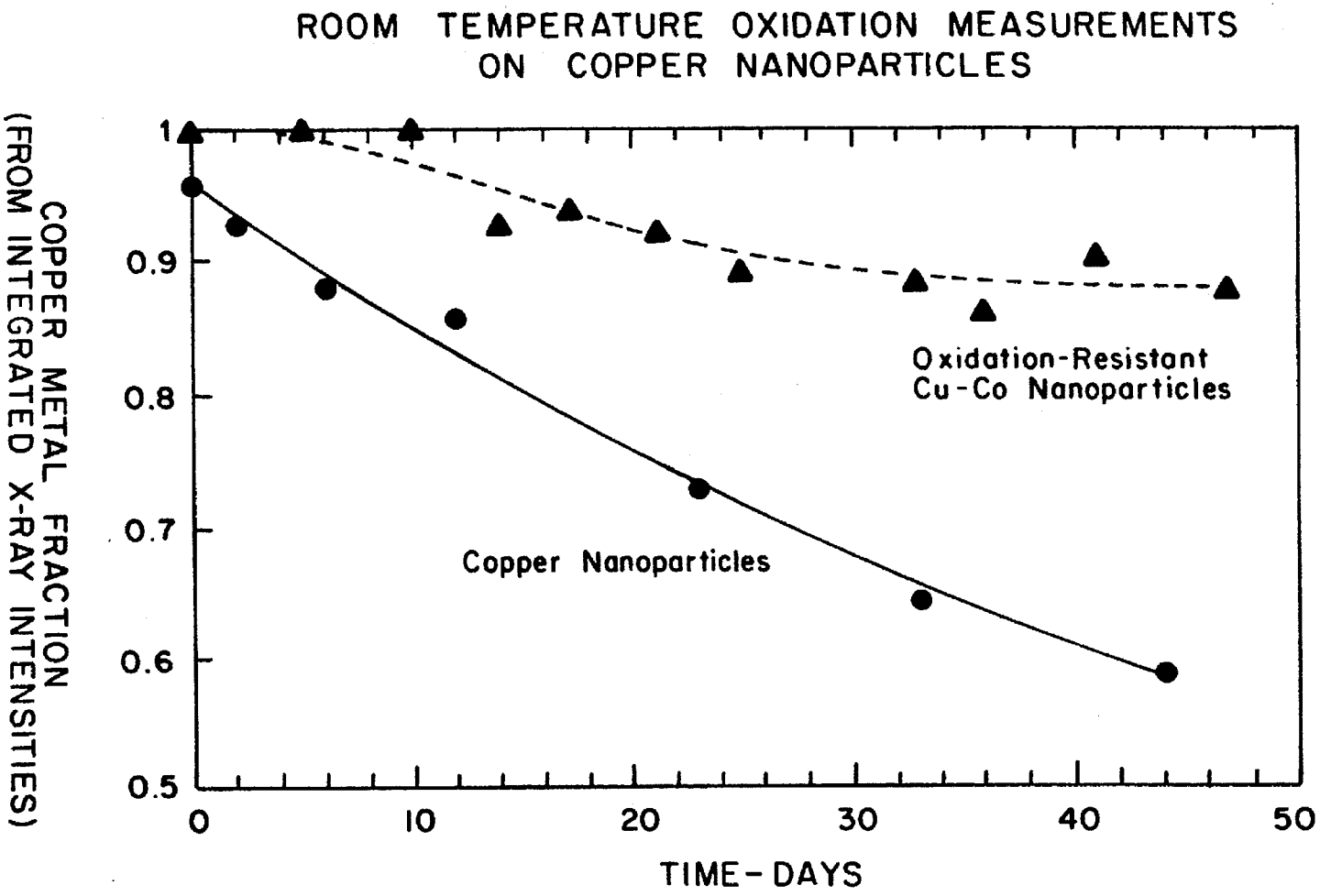
FIG. 3 is a plot of Copper Metal Fraction variations with Time in days as determined from the x-ray diffraction peak intensity data and shows the greater oxidation resistance of the Cu—Co nanoparticles of Example 1 when compared to Cu nanoparticles.

The oxidation resistance of the Cu—Co product nanoparticles of Example 1 was investigated by comparing them with nanoparticles of copper prepared using the identical procedure used in preparing the Cu—Co nanoparticles. Both the Cu—Co and copper nanoparticles were exposed to air and repeated x-ray scans were made to determine the fraction of the copper that was metallic copper and the amount that was copper oxide($Cu_2O$), the most common oxidation product. FIG. 3 compares these results as a function time. What is plotted in FIG. 3 is the area under the Cu(111) x-ray diffraction peak divided by the sum of this area and the area under the $Cu_2O$(111) x-ray diffraction peak. Though this way of estimating the fraction of metallic copper omits both scattering factors and geometric effects, it does provide a good relative measure of the rate at which the particles oxidize. From FIG. 3, one sees that the Cu—Co nanoparticles are much more oxidation resistant than the Cu nanoparticles. The oxidation resistance is not a simple effect due to alloying, i.e. the formation of a solid solution, because the x-ray data shows that phase separation has occured during the 650° C. anneal.

What is claimed is:

1. A process for preparing a particulate product which is oxidation-resistant compared to unoxidized particulate copper, said product consisting of copper and at least one metal selected from the group consisting of nickel, cobalt, iron, manganese, cadmium, tin, magnesium, zinc, calcium, and mixtures thereof, the process comprising the steps of:

(a) dissolving a copper salt and at least one metal salt in a solvent to form a solution of the copper salt and at least one metal salt;

(b) mixing the salt solution and a base to form solid, primary particles of copper and at least one of the metals;

(c) separating the primary particles from the solution;

(d) reducing the primary particles to metallic particles; and (e) heat treating the metallic particles at an elevated temperature for a sufficient time following said reducing step to obtain a particulate, oxidation-resistant product.

2. The process of claim 1 wherein the elevated temperature is high enough to cause the copper to separate from at least one of the metals.

3. The process of claim 2 wherein duration of said reducing step is in the range of about 1 minute to 10 hours; wherein the elevated temperature is in the range of about 300°–900° C.; wherein duration of said heat treating step is in the range of about 1 minute to 10 hours; and wherein the atomic ratio of copper to said at least one metal in the metallic particles is in the range of about 1–5.

4. The process of claim 3 wherein the particulate product consists of copper and one metal other than copper; wherein duration of said reducing step is in the range of about 10 minutes to 2 hours; and wherein duration of said heat treating step is in the range of about 10 minutes to 2 hours.

5. The process of claim 4 wherein said step of dissolving the copper salt and the salt of at least one of the metals takes place in a liquid which is a solvent for the salts.

6. The process of claim 5 wherein the liquid is water, amount thereof being sufficient to form the primary particles after said step of mixing the salt solution and the base; and the base is a liquid which forms the primary particles which are capable of being subsequently reduced to metallic particles.

7. The process of claim 6 wherein the base is sodium hydroxide; and wherein said reducing step is conducted by flowing hydrogen gas through the primary particles at a rate sufficient to convert the primary particles to metallic particles.

8. A process for preparing a particulate product which is oxidation resistant compared to unoxidized particulate copper, with at least 90% of the particles thereof having average diameter in the range of about 1–100 nm; the product consisting of copper and one metal selected from the group consisting of cobalt and iron; wherein atomic ratio of copper to the metal is in the range of about 1–5; copper and the metal in the product being in separate phases; the process comprising the steps of:

(a) dissolving a copper salt and a metal salt in water to form a salt solution;

(b) mixing sodium hydroxide and the salt solution to precipitate primary particles comprising copper and another metal hydroxide;

(c) separating and washing the primary particles from the solution;

(d) flowing hydrogen gas through the primary particles to convert the primary particles to metallic particles; and (e) heat treating the metallic particles at an elevated temperature of about 400°–700° C.

9. The process of claim 8 wherein the copper salt is particulate copper chloride and the metal salt is a metal chloride.

* * * * *